United States Patent [19]

Chagnot

[11] Patent Number: 5,069,272

[45] Date of Patent: Dec. 3, 1991

[54] AIR TO AIR RECOUPERATOR

[75] Inventor: Bruce J. Chagnot, Athens, Ohio

[73] Assignee: Stirling Technology, Inc., Athens, Ohio

[21] Appl. No.: 395,044

[22] Filed: Aug. 17, 1989

[51] Int. Cl.[5] ..... F28D 19/00

[52] U.S. Cl. ..... 165/8; 165/10; 165/7; 165/54

[58] Field of Search ..... 165/8, 7, 10, 54; 55/390, 389

[56] References Cited

U.S. PATENT DOCUMENTS

| | | | |
|---|---|---|---|
| 2,807,258 | 9/1957 | Pennington | 165/7 |
| 3,844,737 | 10/1974 | Macriss et al. | 55/389 |
| 4,188,993 | 2/1980 | Heyn et al. | 165/8 |
| 4,497,361 | 2/1985 | Hajicek | 165/8 |
| 4,563,126 | 1/1986 | Kobayashi et al. | 165/7 |
| 4,874,042 | 10/1989 | Becker | 165/54 |

FOREIGN PATENT DOCUMENTS

| | | | |
|---|---|---|---|
| 748311 | 4/1956 | United Kingdom | 165/54 |

*Primary Examiner*—Albert W. Davis, Jr.
*Attorney, Agent, or Firm*—Killworth, Gottman, Hagan & Schaeff

[57] ABSTRACT

A heat recouperator having a single rotary heat and moisture wheel exchanger uses a random matrix media comprising a plurality of small diameter heat-retentive fibrous material, which provides high thermal efficiency in exchanging heat and moisture between inlet and exhaust air streams.

33 Claims, 4 Drawing Sheets

10
12
14
16
18
19
20
21
22
22'
24
24'
26
27
27'
28
29
29'
30
32
34
34a
36
36a
38
38a
40
42
44
46
48
50
52
52a
54
54a

AIR TO AIR RECOUPERATOR

BACKGROUND OF THE INVENTION

This invention relates to the use of air to air heat recouperators to obtain thermally efficient ventilation of buildings and dwellings, and in particular, to a rotary wheel heat exchanger for room ventilators.

Heat exchangers are used in ventilation systems installed in residential, commercial and industrial buildings to extract and remove heat or moisture from one air stream and transfer the heat or moisture to a second air stream. In particular, rotary wheel heat exchangers are known wherein a wheel rotates in a housing through countervailing streams of exhaust and fresh air, in the winter extracting heat and moisture from the exhaust stream and transferring it to the fresh air stream. In the summer rotary wheel heat exchangers extract heat and moisture from the fresh air stream and transfer it to the exhaust stream, preserving building air conditioning while providing desired ventilation. Fans or blowers typically are used to create pressures necessary for the countervailing streams of exhaust and fresh air to pass through the rotary wheel heat exchanger. Various media have been developed for use in rotary wheel heat exchangers to enhance heat and moisture transfer, for example, Marron et al, U.S. Pat. No. 4,093,435. Typical of rotary wheel heat exchangers are the devices shown by Hajicek, U.S. Pat. No. 4,497,361, Honmann, U.S. Pat. No. 4,596,284, and, those used by Mitani, U.S. Pat. No. 4,426,853 and Coellner, U.S. Pat. No. 4,594,860 in air conditioning systems.

It has been found in the prior art that to achieve thermally efficient ventilation of rooms and buildings, rotary wheel heat exchangers require installation in rather large, fixed, or non-portable heat recouperators, such as that disclosed by Berner, U.S. Pat. No. 4,727,931. The need exists, therefore, for smaller, portable heat recouperators which can still achieve thermally efficient ventilation. Further, the need remains for improved heat exchanger media for rotary wheel heat exchangers to increase the efficiency of heat transfer between the countervailing air streams.

Typically heat recouperators in the prior art employ heat exchangers having a plurality of parallel passages running in the direction of flow, as in Marron et al, U.S. Pat. No. 4,093,435 and Coellner, U.S. Pat. No. 4,594,860. Such passages must be sufficiently small to maximize the total surface area for heat transfer, yet sufficiently large relative to their length to minimize resistance to gas flow. These constraints have made the materials used critical to the effectiveness of such rotary wheel heat exchangers. Thus, for example, Marron et al, U.S. Pat. No. 4,093,435, disclose the use of corrugated paper of a specified composition, density, and thickness in a plurality of layers in a rotary wheel heat exchanger. Further combination with metal foil in a multi-layered material is disclosed. Coellner, U.S. Pat. No. 4,594,860 discloses the use of sheets of polymer film alternating with layers of corrugated or extruded polymer film or tubes, each layer having specified thermal conductivity and specific heat characteristics.

The need exists, therefore, for a compact, rotary wheel heat exchanger for heat recouperators which may be used without the necessity of building modification or connecting duct work as required, for example, with the devices of Tengesdal, U.S. Pat. No. 4,688,626 and Zenkner, U.S. Pat. No. 4,491,171. In addition to ordinary ventilation requirements of residential, commercial, and industrial buildings, the increasing importance of ventilation in residences due to the hazardous build-up of radon, formaldehydes, carbon dioxide and other pollutants presents a further need for inexpensive portable, compact, efficient heat recouperators which are capable of window-mounting. A continuing need exists for the improved design of rotary wheel heat exchangers, including improved, efficient heat exchanger media which avoid the exacting material and design restrictions found in the prior art.

SUMMARY OF THE INVENTION

The present invention meets these needs by providing a compact rotary wheel heat recouperator which may be designed to fit into room windows of a residence or satisfy the needs of commercial or large industrial buildings. The present invention is low cost in both construction and operation. Moreover, a new low cost, easily manufactured, heat exchanger medium is disclosed which has an average heat transfer effectiveness in excess of 90% regardless of temperature difference between inside and outside air.

The heat recouperator features a random matrix media in a rotary wheel heat exchanger. As the heat exchanger rotates, it transfers sensible and latent heat energy between two streams of air through which it passes. The heat exchanger is located in a housing which is baffled to permit the two oppositely directed streams of air to pass through with a minimum of intermixing of the streams. Heat transfer efficiency achieved with random matrix media in the heat recouperator is at least 90%, regardless of the temperature differential between the oppositely directed air streams.

Against the backdrop of prior art heat exchangers, typified by media having a plurality of ordered parallel passages, the media of the present invention is comprised of a plurality of interrelated small diameter, heat-retentive fibrous material, which, relative to the prior art, appear random, thus the term "random matrix media." Random matrix media, however, may encompass more ordered patterns or matrices of small diameter heat-retentive fibrous material, resembling, for example, shredded wheat biscuits or similar cross-hatched patterns.

The interrelation or interconnection of such fibrous material, whether by mechanical or chemical means, results in a mat of material of sufficient porosity to permit the flow of air, yet of sufficient density to induce turbulence into the air streams and provide surface area for heat transfer. Such mats, further, may be cut to desired shapes for use in heat exchangers of various shapes. One fibrous material suitable for use is 60 denier polyester needle-punched felt having 90–94% porosity and approximately 6–6.5 pounds/ft.$^3$ density. However, Kevlar ®, numerous polyester or nylon strands, fibers, staples, yarns or wires may be used, alone or in combination, to form a random matrix media, depending on the application. Once size and flow are determined, material selection exists in a broad range of filament diameters, overall porosity, density, mat thickness, and material thermal characteristics.

In operation, the heat exchanger may be rotated by various means, such as by belts, gears or, as shown, a motor-driven wheel contacting the outer periphery of the heat exchanger container. The random matrix media is retained in the container by screens, stretched over the faces of the container, which have openings of sufficient size to permit substantially free flow of air. Radial spokes, separately or in addition to screens, may also be used extending from the hub of the container through and supporting the random matrix media. Seals are located between the heat exchanger and baffles, angles and brackets in the housing to prevent mixing of the separate streams of air.

Air streams may be provided to the heat recouperator from existing ducts or from fans located in the housing. When fans are used to introduce the air streams, inlet and outlet vents are provided in the housing and are oriented to inhibit recirculation of air from the separate streams. If desired, filters may be added to inlet or outlet air vents. However, the random matrix media itself performs some filtering functions, for example, of pollen, which although driven to the surface of the random matrix media at the inlet, generally does not penetrate the random matrix media and may be blown outward as the heat exchanger rotates through the countervailing exhaust air. Similarly moisture attracted to or condensed in the random matrix media at an inlet is reintroduced in the countervailing exhaust stream.

Because of the heat transfer efficiency of the random matrix media, and related material characteristics, the deliberate inducement of turbulence, and the large surface area for heat transfer, random matrix media lend themselves to minimizing heat exchanger thickness, and permit development of a low cost, compact, portable window-mountable heat recouperator ventilating unit for residential use. Nonetheless, for the same reasons, the present invention may also be applied to meet the largest commercial and industrial applications for rotary wheel heat exchangers.

DETAILED DESCRIPTION OF THE PREFERRED EMBODIMENT

Figure 1:
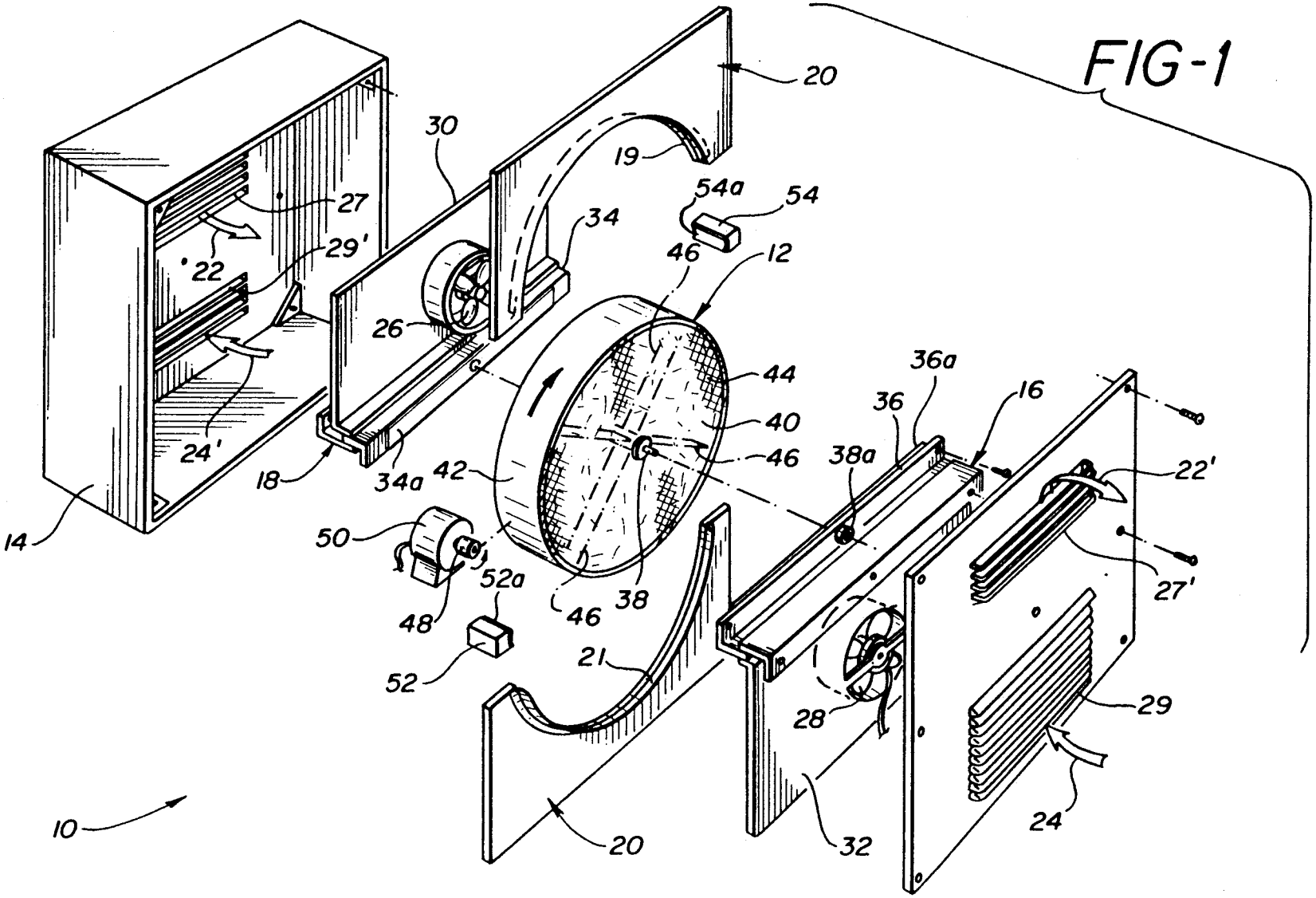
FIG. 1 is an exploded perspective view of the heat recouperator of the present invention.

Referring to FIG. 1, a heat recouperator 10 consisting of a rotary wheel heat exchanger 12, and a housing 14 with baffles 16, 18 and peripheral baffle 20, provides for two oppositely directed streams of air 22, 24 to pass through heat exchanger 12. Flexible seals 19 and 21, preferably of a Teflon ®-based material, attach to peripheral baffle 20, to prevent streams of air 22 and 24 from circumventing heat exchanger 12.

Figure 5:
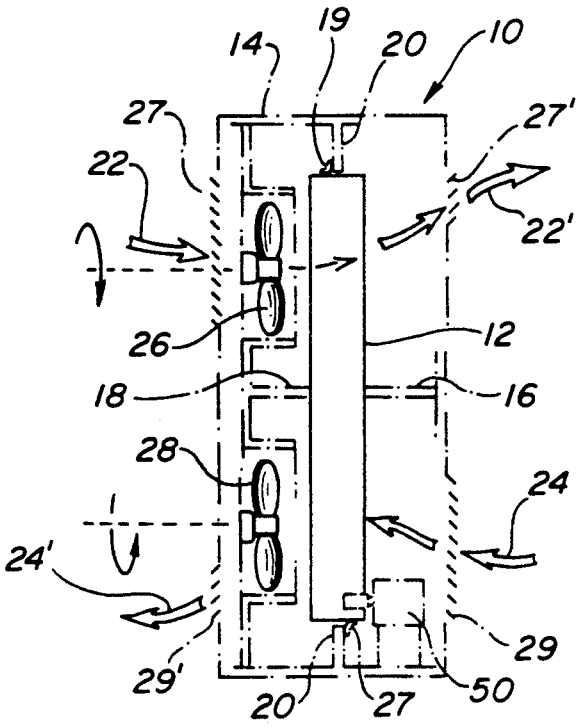
FIG. 5 is a side elevational view of an alternative embodiment of the heat recouperator.

In the preferred embodiment of FIGS. 1–4, motor driven fans 26 and 28 are located at alternate inlets 27 and 29, respectively, and are mounted on fan mounting plates 30 and 32 which are supported, in part, by mounting angles 34 and 36, and connected to a source of electricity (not shown). In an alternative embodiment, FIG. 5 shows fans 26 and 28 mounted on the same side of heat exchanger 12 at inlet 27 and outlet 29', respectively. Regardless of the location of fans 26 and 28, inlet and outlet vents 27 and 29', and 27' and 29 are oriented to inhibit recirculation of streams of air 22 and 24.

All components of heat recouperator 10 are commercially available and made of materials known and used in the art, unless otherwise specified. Housing 14, various baffles 16, 18 and 20, fan mounting plates 30, 32, and mounting angles 34, 36 are preferably made of light weight materials such as plastics, aluminum or mild steel, and are connected by conventional means such as bolts and nuts, welding, sealing or the like. Conventional seals or sealant material (not shown) may also be further used to seal the various elements where connected to prevent intermixing of streams of air 22, 24.

As seen in FIGS. 1–4, heat exchanger 12 is rotatably mounted on an axle assembly 38 such as is known in the art, typically comprising bearings 38*a*. Axle assembly 38 is supported by mounting angles 34 and 36. Seals 34*a* and 36*a*, such as Teflon ®-based tapes, cover flanges of mounting angles 34 and 36, respectively, and abut screens 44 covering the faces of heat exchanger 12. Seals 34*a* and 36*a* typically are designed to contact screens 44 initially and wear to a level which maintains a desired seal between air streams 22 and 24', and 22' and 24. Mounting angle holders 52 and 54 are attached to housing 14 by conventional means and support mounting angles 34 and 36. Seals 52*a* and 54*a*, such as Teflon ®-based tapes, are placed on surfaces of mounting angle holders 52 and 54 adjacent to the container 42. The surfaces of mounting angle holders 52 and 54 are made or machined to match as closely as possible the outer circumference of container 42. Designed to initially contact container 42, seals 52*a* and 54*a* wear to a level which is designed to maintain the desired seal between air streams 22 and 24', 22' and 24, 22 and 22', and 24 and 24'.

Heat exchanger 12 contains random matrix media 40 consisting of a plurality of interrelated small diameter, heat-retentive, fibrous material. Such materials may be interrelated by mechanical means, such as needle punching, or thermal or chemical bonding. Whether entirely random or maintaining some semblance of a pattern, such as a shredded wheat biscuit or cross-hatched fabric, the fibrous material, so interrelated, forms a mat of material which is easy to work with, handle and cut to shape. The random matrix media may be made from one or more of many commercially available filaments, fibers, staples, wires or yarn materials, natural (such as metal wire) or man-made (such as polyester and nylon). Filament diameters from substantially about 25 microns to substantially about 150 microns may be used. Below substantially about 25 microns, the small size of the filaments creates excessive resistance to air flow, and above about 150 microns inefficient heat transfer results due to decreased surface area of the larger filaments. Single strand filaments from substantially about 25 microns to substantially about 80 microns in diameter are preferred, for example a 60 denier polyester needle-punched felt having filament diameters of about 75 to 80 microns.

The present invention is distinguished from the prior art in that deliberate turbulence, rather than directed flow through parallel passages is encouraged by and adds to the effectiveness of the random matrix media. While turbulence in the random matrix media is desirable, resistance to air flow should not be excessive. The mat of material which forms the random matrix media should have a porosity (i.e., percentage of open space in total volume) of between substantially about 83% and substantially about 96%. Below substantially about 83%, resistance to air flow becomes too great, and above substantially about 96% heat transfer becomes ineffective due to the free flow of air. Preferably the mat thickness should be less than 6" to prevent excessive resistance to air flow. Porosity is preferable from substantially about 90% to substantially about 94%, as for example, with 60 denier polyester needle-punched felt, having a porosity of about 92.5%. Representative of random matrix materials which may be used in heat exchanger 12, 60 denier polyester needle-punch felt has a specific gravity of approximately 1.38, thermal conductivity of approximately 0.16 watts/m° K. and specific heat of approximately 1,340 j/Kg° K.

With reference to FIGS. 1–4, in heat exchanger 12, the random matrix media 40 is retained in container 42. Container 42 encloses random matrix media 40 around its periphery, and supports and retains the random matrix media 40 with screens 44 stretched tightly over the faces of container 42. Alternatively, radial spokes 46, shown in phantom on FIG. 1, may be used in lieu of or in addition to screens 44 to support and retain random matrix media 40.

Figure 4:
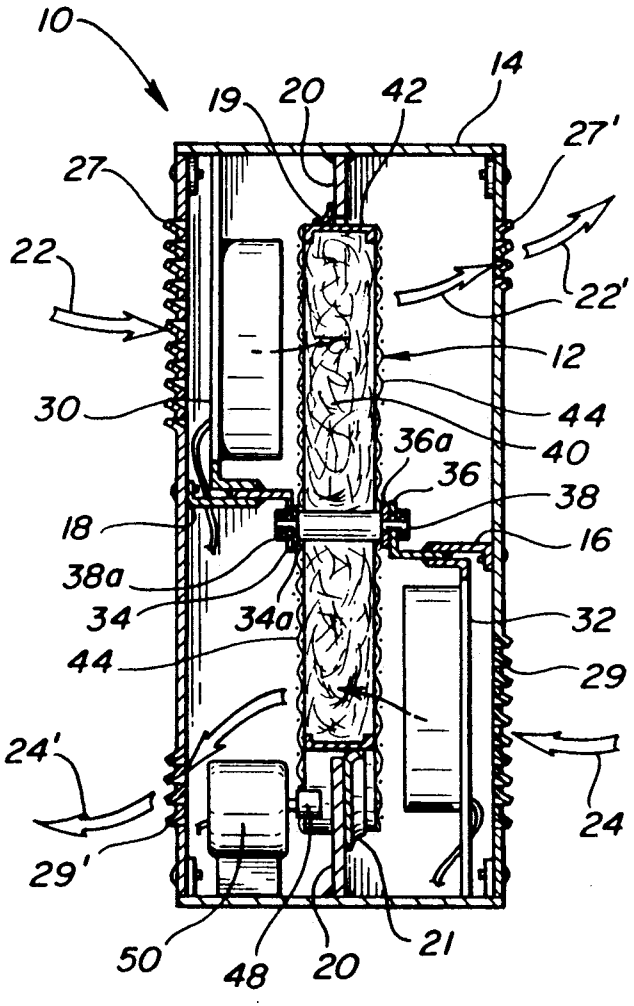
FIG. 4 is a side elevational view of the heat recouperator of FIG. 3 taken at line 4–4.
Figure 3:
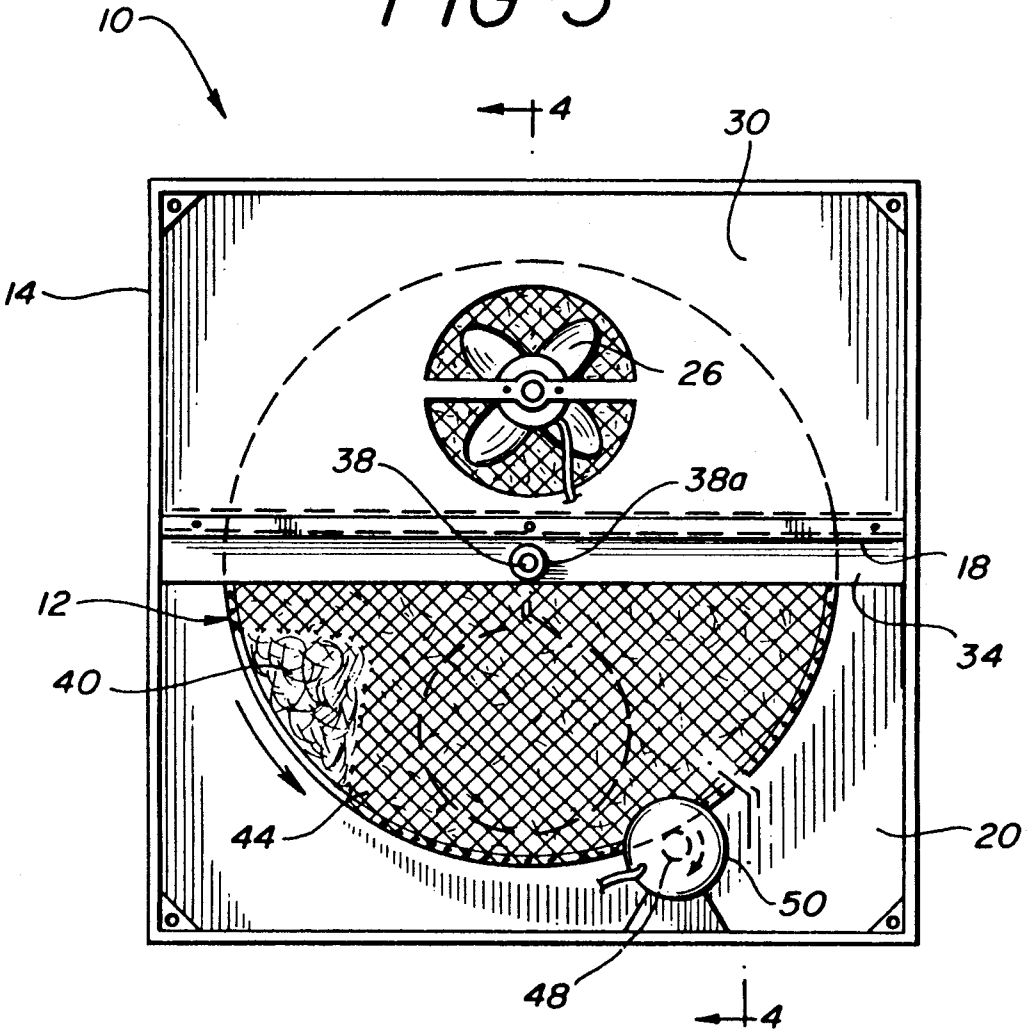
FIG. 3 is a rear elevational view of the heat recouperator of FIG. 2 with the rear housing cover removed.

In operation, heat exchanger 12 is rotated by contact between wheel 48, driven by motor 50, and the outer circumference of container 42 as shown in FIGS. 1, 3 and 4. Motor 50 is connected to a source of electricity (not shown). Rotation of heat exchanger 12 is preferably between about 10 revolutions per minute (rpm) and about 50 rpm. Below about 10 rpm, overall efficiency of the heat recouperator 10 declines. Above about 50 rpm, cross-over or mixing between air streams 22 and 24 occurs as heat exchanger 12 rotates, reducing the amount of ventilation provided.

Figure 2:
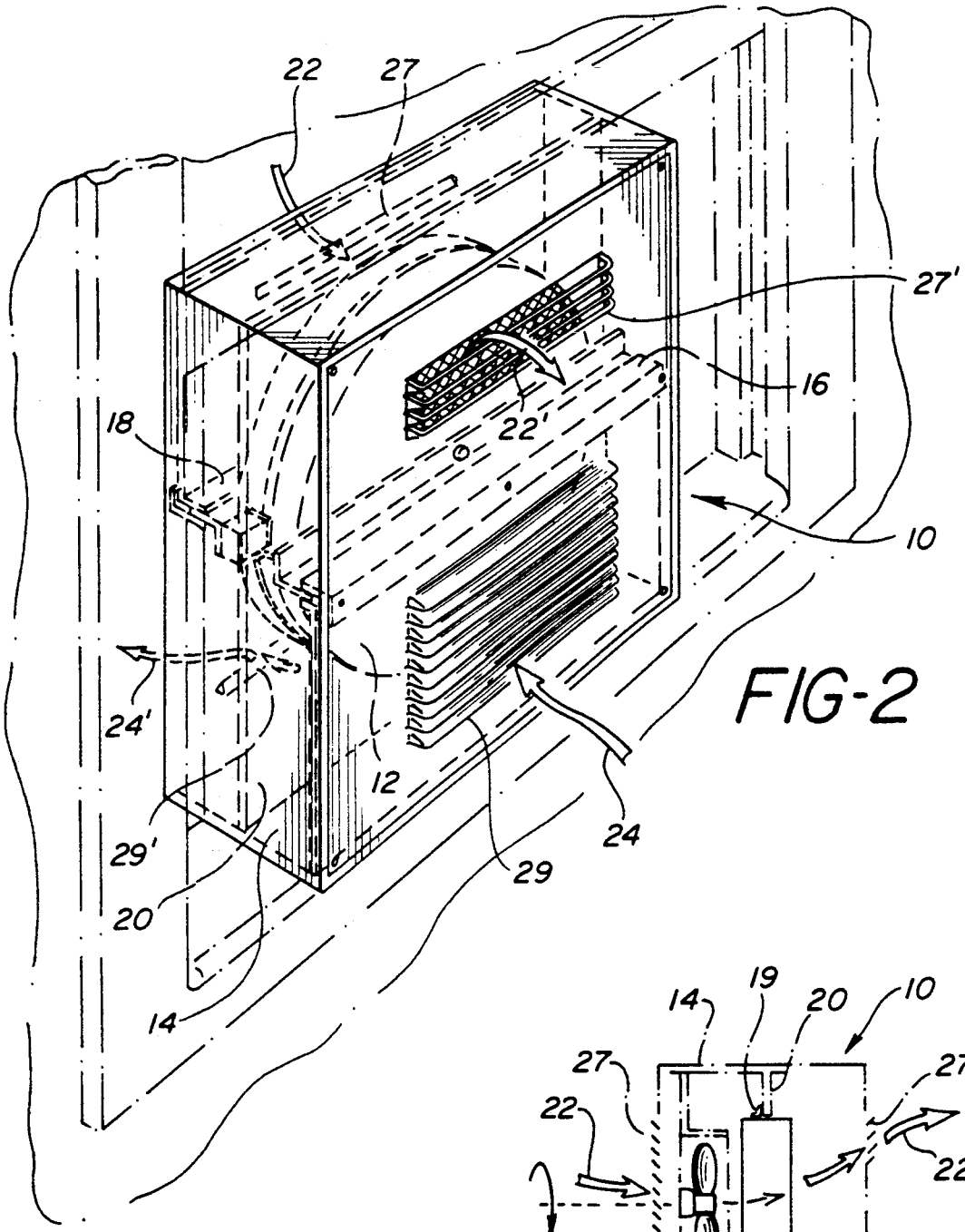
FIG. 2 is a perspective view of the heat recouperator.
Figure 6:
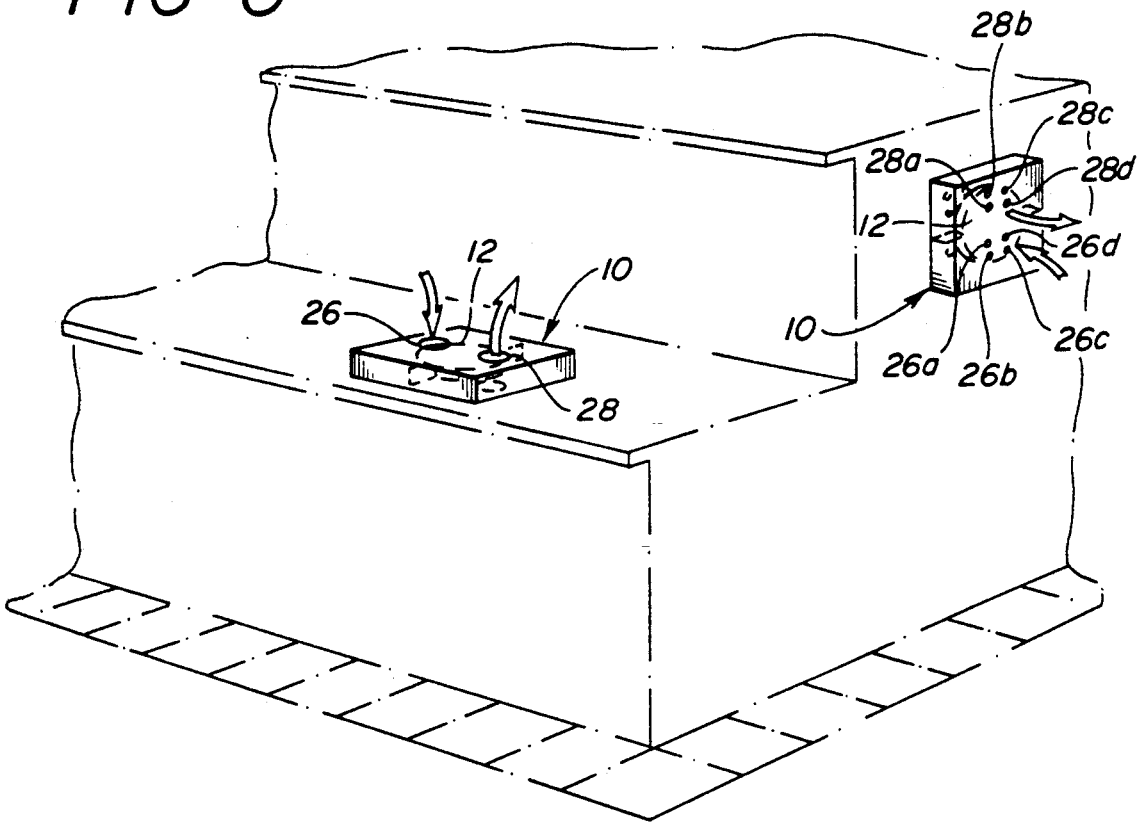
FIG. 6 is a perspective view of an alternative application of the heat recouperator.
Figure 7:
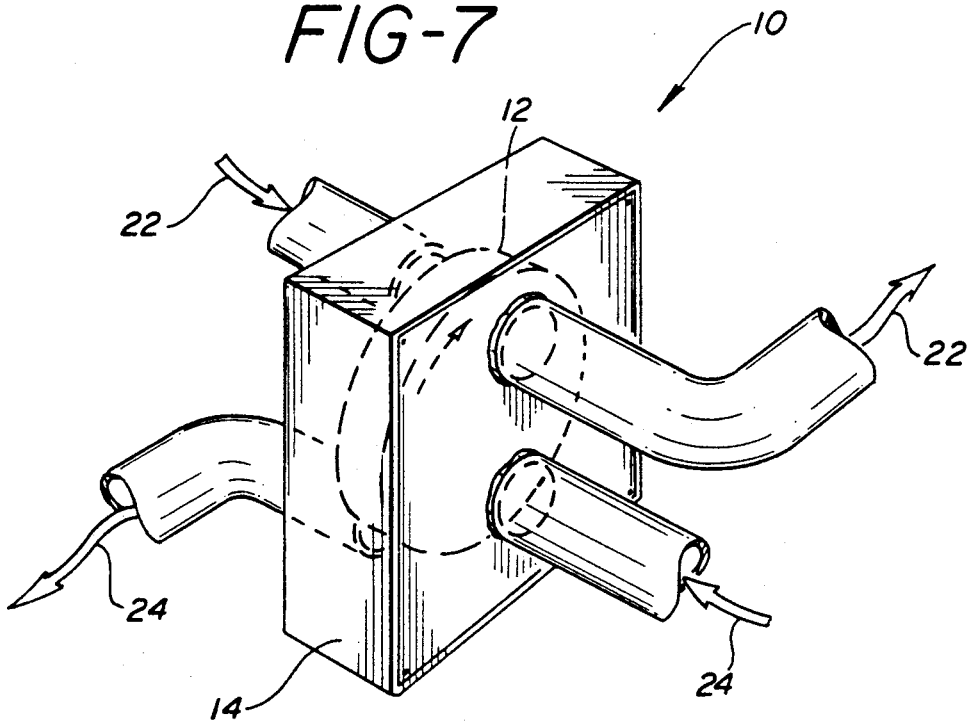
FIG. 7 is a perspective view of an alternative system application of the heat recouperator.

The random matrix media 40 may be used in heat exchangers 12 of various sizes for various applications. One embodiment, shown in FIG. 2, is a window-mounted heat recouperator 12 for ventilation of rooms. For example, a 20 inch × 20 inch × 8.5 inch housing may contain a 17 inch diameter by 1.6 inch thick heat exchanger which may be rotated at 35 rpm–45 rpm with appropriate fans to supply from 80 to 150 cubic feet per minute, (cfm) of air with a thermal efficiency of generally 90% over a wide range of temperature differences. Shown in FIG. 2 embodied in a compact portable window-mounted heat recouperator 10, the random matrix media 40 of the present invention may be used in heat recouperators of many sizes for ventilating applications ranging from approximately 20 cfm for rooms to in excess of 30,000 cfm for large commercial and industrial applications, shown typically in FIG. 6. In other applications, heat recouperators using random matrix media 40 may be placed in forced-air systems and connected to one or more ducts which carry counter-flow streams of air or gas, shown typically in FIG. 7.

In any application, filter screens (not shown) may be added to filter inside or outside air at inlets or outlets 27, 27', 29, or 29'. The random matrix media 40 itself functions as a filter for some particulates. For example, pollen driven to the surface of the heat exchanger 12 at the inlet of a first stream does not substantially penetrate the surface of the random matrix media 40 and may be removed with the exhaust of the second stream. Similarly, moisture condensed at the inlet of a first stream is carried away from the surface of the random matrix media 40 by the exhaust air of the second stream. Thus, humidity and air quality are maintained by the random matrix media 40.

Precise selection of material, composition, filament size, porosity and width of the random matrix media 40 as well as the rate of rotation of heat exchanger 12 and selection of size of fans 26, 28 may vary with each application. However, once the size and flow required for a particular application are fixed, the fans and other components may be sized, and the random matrix media 40 may be selected from appropriate materials within the range of characteristics, particularly filament size and porosity, noted above. Chart 1 below lists typical parameters for the present invention in representative applications.

Chart 1: Representative Heat Recouperator Applications

| Air Flow (cfm) | Application | Disk Diameter (cms) | RPM | Fan Static Pressure (inches of water) | Effectiveness (%) |
|---|---|---|---|---|---|
| 20 | Room | 25 | 20 | .12 | 92.0% |
| 30 | Room | 25 | 20 | .20 | 90.0% |
| 80–150 | Small to medium-sized houses | 43 | 35–45 | .35 | 90.0% |
| 200 | Full medium to large house | 80 | 20 | .11 | 92.5% |
| 300 | Large house | 80 | 20 | .18 | 91.0% |
| 500 | Small commercial such as a restaurant | 100 | 40 | .20 | 91.0% |
| 650 | Small to medium commercial | 100 | 40 | .27 | 90.0% |
| 30,000 | Large commercial, or industrial | Variable depending on application, pressure losses in duct work, etc. | | | 90.0% |

While certain representative embodiments and details have been shown and described for purposes of illustrating the invention, it will be apparent to those skilled in the art that various changes in the apparatus disclosed herein may be made without departing from the scope of the invention which is defined in the appended claims. It is further apparent to those skilled in the art that applications using the present invention with gases other than air may be made without departing from the scope of the invention defined in the appended claims.

What is claimed is:

1. A heat recouperator for ventilating rooms and buildings with minimum loss of heating or cooling, said heat recouperator comprising:

a compact housing adapted to be mounted in a window having first and second sections adapted to convey separate streams of air;

a unitary heat and moisture exchanger, comprising a random matrix media and means to support said random matrix media, said unitary heat and moisture exchanger rotatably mounted in said compact housing and adapted to intersect said first and second sections;

said random matrix media comprising a mat of small diameter heat-retentive fibrous material interrelated by mechanical means to form said mat; and means to rotate said unitary heat and moisture exchanger.

2. A heat recouperator as recited in claim 1 wherein said mat is comprised of polyester needle-punched felt.

3. A heat recouperator as recited in claim 2 wherein said mat of interrelated small diameter heat-retentive fibrous material is comprised of filaments of from substantially about 25 microns to substantially about 150 microns in diameter.

4. A heat recouperator as recited in claim 2 wherein said mat is comprised of filaments of from substantially about 25 microns to substantially about 80 microns and is adapted to have substantially 90% to 94% porosity.

5. A heat recouperator as recited in claim 1 wherein said random matrix media has a porosity from substantially about 83% to substantially about 96%.

6. A heat recouperator as recited in claim 1 wherein said random matrix media is comprised of filaments from substantially about 25 microns to substantially about 150 microns in diameter, and adapted to have a porosity of from substantially about 83% to substantially about 96%.

7. A heat recouperator as recited in claim 1 wherein said mat is substantially circular in shape.

8. A heat recouperator as recited in claim 1 wherein said unitary heat and moisture exchanger is adapted to be rotated from substantially about 10 rpm to substantially about 50 rpm inside said compact housing.

9. A heat recouperator as recited in claim 1, further comprising:

means to force said separate streams of air through said first and second sections of said compact housing in opposite directions.

10. A heat recouperator as recited in claim 9 wherein said means to force said separate streams of air comprise one or more fans.

11. A heat recouperator as recited in claim 1 wherein said means to support said random matrix media comprises a container enclosing said random matrix media; and screen material attached along two parallel faces of said container, said container and said screen material adapted to allow substantially free passage of air through said random matrix media.

12. A heat recouperator as recited in claim 1 wherein said means to support said random matrix media comprises:

a container enclosing said random matrix media having one or more apertures along each of two parallel faces of said container, said one or more apertures adapted to allow the substantially free flow of air through said random matrix media; and spokes extending radially from the hub of said container outward through said random matrix media towards the periphery of said container.

13. A heat recouperator as recited in claim 1 wherein said means to rotate said unitary heat and moisture exchanger comprises:

one or more motors; and one or more drive wheels rotatably connected to said one or more motors, said one or more drive wheels communicating with the periphery of said unitary heat and moisture exchanger and adapted to transfer rotary motion of said one or more motors to said unitary heat and moisture exchanger.

14. A heat recouperator as recited in claim 1 wherein said compact housing further comprises:

a frame, wherein at least two sides include one or more apertures communicating with said first and second sections;

one or more baffles defining said first and second sections;

a peripheral baffle secured to the inside of said compact housing, having an aperture wherein said unitary heat and moisture exchanger may rotate;

means for rotatably mounting said unitary heat and moisture exchanger in said compact housing; and one or more seals, said seals adapted to prevent passage of air between said first and second sections or between said peripheral baffle and said unitary heat and moisture exchanger.

15. A heat recouperator as recited in claim 14 further comprising:

one or more fans; and one or more fan mounting plates attached to said compact housing, said one or more fans mounted on said one or more fan mounting plates.

16. A heat recouperator as recited in claim 15 wherein said one or more fans are located at the inlet sides of said first and second sections.

17. A heat recouperator as recited in claim 14 wherein said apertures in said sides comprise one or more inlet vents and outlet vents, said inlet vents and outlet vents oriented to inhibit recirculation of said separate streams of air.

18. A heat recouperator as recited in claim 14 wherein said means for rotatably mounting said heat exchanger in said housing further comprises:

one or more mounting angle holders attached to said frame;

one or more mounting angles supported by said mounting angle holders; and an axle assembly secured centrally in said heat exchanger and rotatably mounted in said mounting angles.

19. A heat exchanger as recited in claim 18 wherein said one or more seals communicate between said peripheral baffle and said heat exchanger, between said one or more mounting angles and said heat exchanger, or between said one or more mounting angles and said heat exchanger.

20. A unitary heat and moisture exchanger comprising:

a random matrix media for transferring sensible and latent heat energy, accompanied or not by moisture, between two streams of air within which the unitary heat and moisture exchanger is situated, said random matrix media comprising a mat of small diameter heat-retentive fibrous material interrelated by mechanical means to form said mat;

means for supporting said random matrix media; and means for rotating said random matrix media.

21. A unitary heat and moisture exchanger as recited in claim 20 wherein said random matrix material is comprised of filaments of between substantially about 25 microns and substantially about 150 microns in diameter.

22. A unitary heat and moisture exchanger as recited in claim 20 wherein said random matrix media has a porosity of from substantially about 83% to substantially about 96%.

23. A unitary heat and moisture exchanger as recited in claim 20 wherein said random matrix media comprises material is comprised of filaments from substantially 25 microns to substantially 150 microns in diameter, said random matrix media adapted to have a porosity of from substantially 83% to substantially 96%.

24. A unitary heat and moisture exchanger as recited in claim 18 wherein said mat is comprised of filaments of from substantially 25 microns to substantially 80 microns and is adapted to have 90 to 94% porosity.

25. A unitary heat and moisture exchanger as recited in claim 20 wherein said random matrix media is polyester needle-punched felt.

26. A heat exchanger as recited in claim 20 wherein said random matrix media comprises filaments from substantially about 25 microns to substantially about 150 microns in diameter, and said random matrix media is adapted to have a porosity of from substantially about 83% to substantially about 96%.

27. A heat exchanger as recited in claim 26 wherein said filaments of said random matrix media are further comprised of polyester having a specific gravity of substantially about 1.38, thermal conductivity of substantially about 0.16 watts/m° K., and specific heat of substantially about 1,340 j/Kg° K.

28. A unitary heat and moisture exchanger as recited in claim 18 wherein said random matrix media is comprised of a mat of metal wire.

29. A unitary heat and moisture exchanger as recited in claim 20 wherein said means for supporting said random matrix media comprises:

a container enclosing said random matrix media, said container further comprising means for retaining said random matrix media adapted to allow the substantially free flow of air through said random matrix media.

30. A unitary heat and moisture exchanger as recited in claim 29 wherein said means for retaining said random matrix media comprises screen material.

31. A unitary heat and moisture exchanger as recited in claim 18 wherein said means for rotating said random matrix media comprises:

an axle assembly communicating with said means for supporting said random matrix media;

one or more motors; and means for transferring rotary motion of said one or more motors to said means for supporting said random matrix media thereby rotating said random matrix media in cooperation with said axle assembly.

32. A heat recouperator for ventilating rooms and buildings with minimum loss of heating or cooling, said heat recouperator comprising:

a compact portable housing having first and second sections adapted to convey separate streams of air;

a heat exchanger, comprising a random matrix media and means to support said random matrix media, said heat exchanger rotatably mounted in said compact portable housing and adapted to intersect said first and second sections, and said random matrix media comprising small diameter, heat-retentive fibrous material interrelated by mechanical means; and means to rotate said heat exchanger.

33. A heat recouperator for ventilating rooms and buildings with minimum loss of heating or cooling, said heat recouperator comprising:

a compact portable housing having first and second sections adapted to convey separate streams of air;

a heat exchanger, comprising a random matrix media and means to support said random matrix media, said heat exchanger rotatably mounted in said compact portable housing and adapted to intersect said first and second sections, and said random matrix media comprising polyester needle-punched felt; and means to rotate said heat exchanger.

* * * * *

UNITED STATES PATENT AND TRADEMARK OFFICE

CERTIFICATE OF CORRECTION

PATENT NO. : 5,069,272

DATED : December 3, 1991

INVENTOR(S) : Catherine J. Chagnot

It is certified that error appears in the above-identified patent and that said Letters Patent is hereby corrected as shown below:

Title page:

Item (75) inventor: should read-- Catherine J. Chagnot--.

Signed and Sealed this

Twenty-eighth Day of April, 1992

*Attest:*

HARRY F. MANBECK, JR.

*Attesting Officer*

*Commissioner of Patents and Trademarks*